United States Patent [19]

DiMarco et al.

[11] Patent Number: 4,675,635

[45] Date of Patent: Jun. 23, 1987

[54] ELECTROMAGNETIC STRUCTURE FOR A CIRCUIT BREAKER

[75] Inventors: Bernard DiMarco, Lilburn, Ga.; Charles W. Stanford, Bellefontaine, Ohio

[73] Assignee: Siemens Energy & Automation, Inc., Atlanta, Ga.

[21] Appl. No.: 905,795

[22] Filed: Sep. 10, 1986

[51] Int. Cl.[4] ..... H01H 75/12; H01H 75/08

[52] U.S. Cl. ..... 335/35; 335/43

[58] Field of Search ..... 335/35, 23, 36, 37, 335/38, 39, 40, 41, 42, 43; 337/70, 71, 75

[56] References Cited

U.S. PATENT DOCUMENTS 3,005,066 10/1961 Powell ..... 335/43

4,187,482 2/1980 Kosup ..... 335/12

*Primary Examiner*—Harold Broome

*Attorney, Agent, or Firm*—Volker R. Ulbrich

[57] ABSTRACT

A circuit breaker has a bimetallic element and an electromagnetic element. The bimetallic element has one end connected to the line terminal and the other end connected to the pigtail connector. A shunt is connected at one end to the pigtail connector and has a contact on the other end matable with the line terminal contact. The shunt is connected at one end to the pigtail connector immobilizing the pigtail so that it does not interfere with the operation of the bimetallic element. The electromagnet is positioned about the bimetallic element and has an armature which is movable to trip the circuit breaker. The shunt element has a spring connected which biases the armature away from the electromagnet.

12 Claims, 3 Drawing Figures

ELECTROMAGNETIC STRUCTURE FOR A CIRCUIT BREAKER

Cross-Reference to Related Applications

This application is related to application Ser. No. 905,796 "Line Terminal Assembly For A Circuit Breaker", Bernard Dimarco and Charles Stanford.

Background of the Invention

This invention relates generally to a circuit breaker and more particularly to an electromagnetic structure for tripping the circuit breaker in response to certain conditions.

It is common for circuit breakers to incorporate thermal and electromagnetic elements for tripping the circuit breaker under various conditions. For example, the thermal elelment reponds to overcurrent conditions to trip the breaker when the rated current is exceeded for a period sufficient to cause the bimetallic thermal element to distort sufficiently to trip the breaker. The thermal element is generally ineffective against large short duration currents which are insufficient to heat the bimetallic element to the extent necessary to trip the breaker. However, the electromagnetic element responds to high current conditions to operate the trip lever of the circuit breaker to trip the circuit breaker.

In a typical circuit breaker, the bimetallic thermal element carries the circuit breaker current and is connected to the contacts of the circuit breaker by a flexible connection such as a pigtail connector. Although the pigtail is a flexible element, when current is flowing it is an electromagnetic element which can intefere with the normal smooth operation of the bimetallic element. Understandably, this interference from the pigtail is highly undesirable because it effects the bimetallic element and therefore the calibration of the circuit breaker. Accordingly, it will be appreciated that it would be highly desirable to provide a flexible connector for the bimetallic element which does not interfere with the operation of the bimetallic element. The electromagnetic element has an armature which moves in response to the attracrtive force of the electromagnet to trip the circuit breaker. It is desirable to keep the number of electromagnetic components to a minimum to simplify manufacture and assembly. One of the problems with a simple assembly is that a simple assembly sometimes makes calibration more difficult because of the imprecision of the relative few parts. Also, it is possible for the armature to fail to come to rest in the same position each time owing to manufacturing tolerances or residual magnetism. Accordingly, it will be appreciated that it would be highly desirable to provide an electromagnetic structure for a circuit breaker which facilitates easy calibration yet provides a simple, reliable structure.

Since the bimetallic element is a current-carrying element which is constructed of scarce, or at least expensive, material, it is prudent to minimize the amount which is used. Therefore, the bimetallic element will have the smallest cross-section and dimensions for providing the required function while carrying the rated current of the circuit breaker. This means that when fault current is present, there must be provision made for protecting the bimetallic element from the fault current. Such an arrangement is known as a shunt. Accordingly, it will be appreciated that it would be highly desirable to provide a shunt for the current carrying bimetallic element which protects the bimetallic element from fault current without interfering with the calibration of the circuit breaker.

Accordingly, it is an object of the present invention to provide a circuit breaker which has both thermal and electromagnetic elements.

Another object of the present invention is to provide thermal and magnetic elements which are simple in construction.

Another object of the present invention is to provide a circuit breaker with thermal and magnetic elements which are easy to calibrate.

Summary of the Invention

Briefly stated, in accordance with one aspect of the invention, the foregoing objects are achieved by providing a circuit breaker having a line terminal with a contact. A bimetallic element has one end connected to the line terminal and the other end connected to a pigtail connector. A shunt is connected at one end to the pigtail connector and has a contact on the other end matable with the line terminal contact. An electromagnet is positioned about the bimetallic element. The electromagnet includes an armature movable to trip the circuit breaker in response to current flow through the circuit breaker of a preselected magnitude. The armature moves the shunt and closes the shunt contact prior to tripping the circuit breaker.

Brief Description of the Drawing

While the specification concludes with the claims particularly pointing out and distinctly claiming the subject matter which is regarded as the invention, it is believed that the invention will be better understood from the following description of the preferred embodiment taken in conjunction with the accompanying drawings in which:

Description of the Preferred Embodiment

Figure 1:
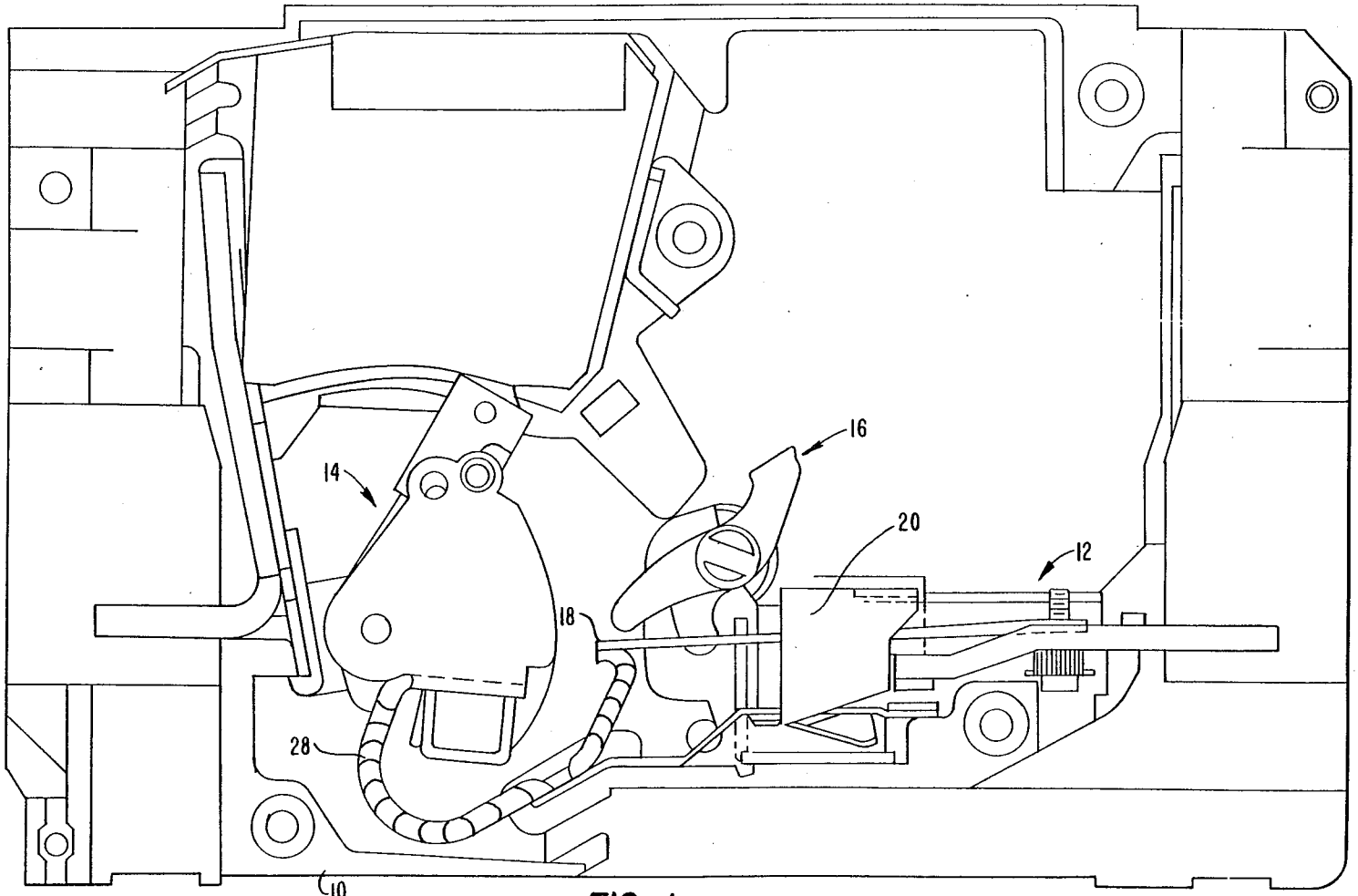
FIG. 1 illustrates a molded case circuit breaker with the cover of the molded case removed revealing the internal structure of the circuit breaker.
Figure 3:
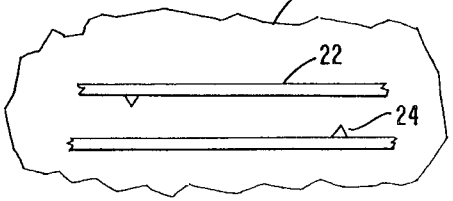
FIG. 3 illustrates crushable ribs in accordance with the present invention.

Referring to FIG. 1, a molded case circuit breaker includes a molded case 10 which has various compartments molded therein for placement of internal parts of the circuit breaker such as the line terminal assembly 12, the contact assembly 14, the trip lever assembly 16, the thermal element 18 and the magnetic element 20. As best seen in FIG. 3 the molded case 10 also includes plates or ribs 22 which form passageways into which elements such as the line terminal assembly may be inserted. Preferably, the passageways are lined with crushable ribs 24 which deform when a line terminal or othr element is inserted therein to hold the element in the passageway tightly.

Figure 2:
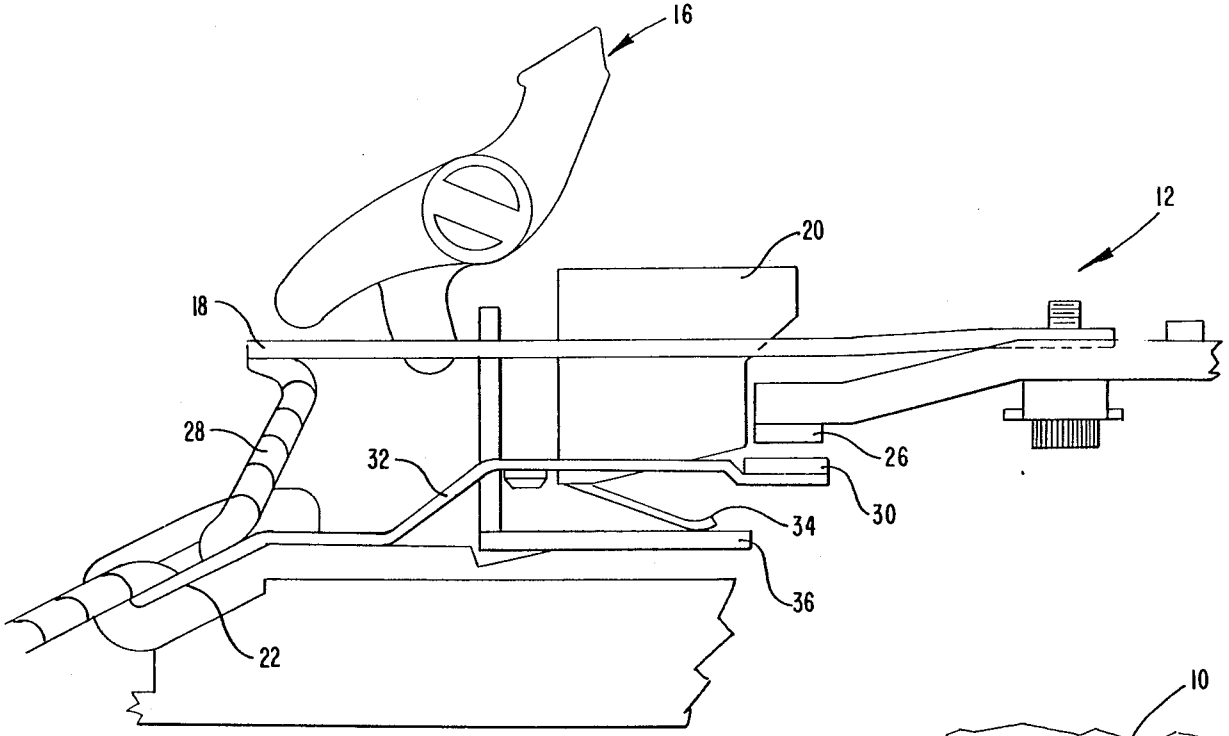
FIG. 2 is a somewhat enlarged diagrammatic view of the thermal and magnetic elements of the circuit breaker.

Referring to FIGS. 1 through 3, the line terminal assembly 12 includes a line terminal element which has a contct 26 thereon. Also attached to the line terminal element is one end of the bimetallic element 18. It will be noted that in the drawing current flows in through the aligned terminal assembly 12 through the bimetal 18 and into the pigtail 28. The line terminal assembly 12 is more fully described in the above referenced application Ser. No. 905,796 which is incorporated herein by reference.

The shunt contact 26 controllably mates with shunt contact 30 which is connected to the shunt element 32. A shunt spring 34 is preferably pivotally attached to the shunt element 32. The shunt element 32 has its end opposite the shunt contact 30 connected to the pigtail 28, preferably by welding, at a location of the pigtail intermediate the bimetallic element 18 in the contact assembly 14. The shunt element has an elongated configuration with one end, the end containing contact 30, free and the other end forcibly positioned in a passageway in the circuit breaker case. By this construction, the pigtail is rendered immobile at its connection point to the shunt so that the pigtail does not exert an unwanted influence upon the bimetallic element and does not interfere with operation or calibration.

The electromagnet is positioned about the bimetallic element. The electromagnet has a general U configuration with the bimetallic element positioned between the legs of the U. The bimetallic element can have protrusions (not shown) which assist in locating it in the molded case. As current flows through the electromagnet 20, it attracts armature 36. As seen in FIG. 2, the legs of the U-shaped electromagnet are slanted or inclined so that as the electromagnet attracts the armature, it causes the armature to rotate in a counterclockwise direction to actuate the trip assembly 16 to trip the circuit breaker.

The shunt 32 also passes between the legs of the U so that the spring 34 contacts the armature 36 and urges the armature away from the electromagnet. By this construction, the armature is returned to its rest position after each operation. This insures that the armature is returned to the same starting location for reliable calibration.

Operation of the circuit breaker is simple and straightforward. Under normal operating conditions, the shunt contacts 26, 30 are open as shown in FIG. 2. With the shunt contacts open, normal current flow is through the bimetallic element 18 and pigtail 28. The higher the current flow the more heat that is generated in the bimetallic element and the more it will bend toward the tripping mechanism 16. When the current is of sufficient magnitude and duration, the bimetallic element will contact the tripping mechanism 16 and trip the circuit breaker. At this point, the current can be sufficient for the bimetallic element to contact the tripping mechanism 16 to trip the breaker yet be insufficient for the electromagnet to sufficiently attract armature 36 against the force of the spring 34 to close the shunt contacts 26, 30. Thus, the thermal bimetallic element handles normal tripping current.

When a fault occurs, there will be a very large current flow for a very short time period. A large current causes the electromagnet to generate an electromagnetic attracting force which attracts armature 36 against the force of the shunt spring 34. As the current builds, the armature is attracted more toward the electromagnet causing the armature to begin to rotate in a counterclockwise direction against the force of the spring which forces the spring to act on the shunt element 32 and thus close the shunt contacts 26 and 30. When the shunt contacts close, current is shunted around the bimetallic element and through the shunt element 32 to the pigtail. This will help protect the bimetallic element. The armature is simple in construction and light in weight and will respond very quickly to the electromagnet which responds quickly to the rise in current. Under fault conditions, the magnitude of the current will be sufficient to fully attract the armature so that the armature rotates counterclockwise closing the shunt contacts and continuing to activate the tripping mechanism 16 to trip the breaker. It will be undersood that fault current generally is many times greater than the rated current of the circuit breaker so that the tension of the spring 34 can be adjusted so that the armature does not move until a preselected minimum current flows through the bimetallic element. In this way, current flow through the bimetallic element will be of sufficient duration to trip the circuit breaker under all conditions. Also, when the shunt contacts close, the armature is still attracted towards the electromagnet because all of the current still flows within the electromagnet structure.

It will now be understood that there has been presentd a circuit breaker which includes a thermal element and a magnetic element which cooperate to trip the breaker. The thermal element is constructed so that it is free of interference from the pigtail connector which could interfere with calibration of the circuit breaker. The magnetic element is simple in construction and highly responsive so that it operates efficiently, yet is prepositioned for easy calibration. As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured by Letters Patent of the United States is:

1. A circuit breaker, comprising:

a line terminal having a contact;

a pigtail connector;

a bimetallic element having one end connected to the line terminal and the other end connected to the pigtail connector;

a shunt connected at one end to the pigtail connector and having a contact on the other end matable with said line terminal contact; and an electromagnetic positioned about the bimetallic strip having an armature movable to trip the circuit breaker in response to the current flow through the circuit breaker of a preselected magnitude, said armature moving said shunt and closing the shunt contact prior to tripping said breaker.

2. A circuit breaker according to claim 1, wherein the circuit breaker has a molded case defining a passageway having ribs and said shunt is forcibly positioned in said passageway deforming said ribs.

3. A circuit breaker according to claim 2, including a movable contact arm connected to one end of the pigtail connector and wherein the shunt is connected to the pigtail intermediate connection of the pigtail to the bimetallic element and movable contact, said connection to the shunt immobilizing said pigtail and maintaining the bimetallic element free of interference from said pigtail.

4. A circuit breaker according to claim 1, wherein the circuit breaker has a molded case defining a passageway having ribs and wherein said shunt has an elongated configuration with one end free and the other end forceable positioned in said passageway and wherein a shunt spring is connected to the shunt urging the armature from the electromagnet.

5. A circuit breaker according to claim 4, wherein the shunt spring is pivotally connected to the shunt.

6. A circuit breaker according to claim 1, wherein the electromagnet has a general U configuration with the legs of the U slanted causing the armature to rotate in a counterclockwise direction to trip the breaker as the electromagnet attracts the armature.

7. A circuit breaker, comprising:

a line terminal having a contact;

a pigtail connector;

a bimetallic element having one end connected to the line terminal and the other end connected to the pigtail connector;

a shunt connected at one end to the pigtail connector and having a contact on the other end matable with said line terminal contact; and an electromagnet having a general U configuration and having the bimetallic strip and shunt passing through the legs of the U, said electromagnet having an armature movable to trip the circuit breaker in response to the current flow through the circuit breaker of a preselected magnitude, said armature moving said shunt and closing the shunt contact prior to tripping said breaker.

8. A circuit breaker according to claim 7, wherein the legs of the U-shaped electromagnet are slanted causing the armature to rotate in a counterclockwise direction to trip the breaker as the electromagnet attracts the armature.

9. A circuit breaker according to claim 7, wherein the circuit breaker has a molded case defining a passageway having ribs and said shunt is forcibly positioned in said passageway deforming said ribs.

10. A circuit breaker according to claim 9, including a movable contact arm connected to one end of the pigtail intermediate connection of the pigtail to the bimetallic element and movable contact, said connection to the shunt immobilizing said pigtail and maintaining the bimetallic element free of interference from said pigtail.

11. A circuit breaker according to claim 7, wherein the circuit breaker has a molded case defining a passageway having ribs and wherein said shunt has an elongated configuration with one end free and the other end forceably positioned in said passageway and wherein a shunt spring is connected to the shunt urging the armature from the electromagnet.

12. A circuit breaker according to claim 11, wherein the shunt spring is pivotally connected to the shunt.

* * * * *